United States Patent [19]

Oversohl

[11] 4,068,589

[45] Jan. 17, 1978

[54] METHOD FOR THE PRODUCTION OF COMBUSTIBLE AMMUNITION CONTAINERS AND PRODUCT THEREOF

[75] Inventor: Wilhelm Oversohl, Koblenz-Karthause, Germany

[73] Assignee: Wasag Chemie AG, Munich, Germany

[21] Appl. No.: 755,653

[22] Filed: Dec. 30, 1976

[51] Int. Cl.[2] ..... F42B 5/06

[52] U.S. Cl. ..... 102/43 R; 102/101; 264/3 R; 149/14; 149/96

[58] Field of Search ..... 102/43 R, 101, DIG. 1; 149/14, 96, 99, 100; 264/3 R, 3 E

[56] References Cited

U.S. PATENT DOCUMENTS

| | | | |
|---|---|---|---|
| 1,334,462 | 3/1920 | Landrin | 264/3 R |
| 2,940,390 | 6/1960 | Bergstrom et al. | 264/3 R X |
| 3,073,242 | 1/1963 | Hewson | 102/101 |
| 3,217,651 | 11/1965 | Braun et al. | 102/101 |
| 3,413,384 | 11/1968 | Olliff, Jr. | 264/3 R |
| 3,534,018 | 10/1970 | Brissaud et al. | 149/96 X |
| 3,926,697 | 12/1975 | Humbert et al. | 149/14 |
| 4,009,231 | 2/1977 | Wasserman et al. | 264/3 R |

*Primary Examiner*—Peter A. Nelson
*Attorney, Agent, or Firm*—Hammond & Littell

[57] ABSTRACT

A unitary combustible or explosive munitions container of uniform cross-section but of non-uniform linear composition is provided by depositing under suction two different fluid aqueous suspensions of fibrous propellant material and cellulose papermaking fibers on different touching zones of a hollow foraminous shape having an interior under vacuum, thereby forming a water-laid web on said shape, hot pressing the web to desired shape, and trimming the product to size. The process is suitable for the manufacture of cartridge cases and other ammunition containers.

18 Claims, 4 Drawing Figures

VAC.

4
11a
2
3a
11b
5
3
8
A
A'
6
1
9
12
10
7

METHOD FOR THE PRODUCTION OF COMBUSTIBLE AMMUNITION CONTAINERS AND PRODUCT THEREOF

FIELD OF THE INVENTION

The invention relates to a method for producing combustible shaped ammunition components (e.g., cartridge cases, propellant charge containers and ignition tubes) of uniform cross-section composition but of non-uniform linear composition from aqueous suspensions of mixtures of nitrocellulose and cellulose fibers and a binder. The invention includes the methods involved, the components so produced before and after hot pressing, and apparatus for the production of the components.

RELATED DISCLOSURE

DAS No. 1,446,889
DAS No. 1,909,709
German Pat. No. 1,918,320

BACKGROUND OF THE INVENTION

It is known to produce combustible shaped ammunition components from cellulose and nitrocellulose fibers (and synthetic fibers) by using synthetic resin binders, e.g., polyurethanes, according to known felting methods. In the known method, pentaerythrityl tetranitrate or trimethylenetrinitroamine can be incorporated to improve the combustibility of the compositions. All the components (possibly with the exception of the binder) are suspended in water and wet webs (i.e., crude blanks or preforms) are produced from the suspension thus formed by dipping a shaped form or "negative" into an aqueous suspension of the fibers and depositing the fibers on the form by the use of suction. The webs thus obtained are dried and compressed in heated presses and trimmed to measure. When the binder cannot be added to the suspension, it is introduced by impregnation of the pressed component. The blanks and therefore the final dry products produced according to this method are necessarily homogeneous in composition because of the nature of the production method employed.

However, in testing these combustible ammunition components, it was found that a residue-free combustion of the component depends frequently to a great extent on the pressure produced during firing, on the firing temperature, and on the temperature of the gas produced by the powder. This is of particular importance in charge containers from which different propellent charges are fired. Moreover, the fact that cartridge cases are subjected to combustion within the powder chamber of a gun has an effect on the extent to which these cases are transformed into gases, because the bottoms of cartridge cases in the powder chambers of guns burn more difficultly than the open ends of cartridge cases.

The finding that the powder chamber of tubular weapons (e.g., guns) cannot be considered a uniform reaction chamber (so far as the combustion of cartridge cases therein is concerned) means that ammunition components of homogeneous composition are not successful because their composition must be adjusted to the least favorable combustion conditions in the powder chamber in order to positively avoid the presence of residues. Better combustion properties require, for example, a higher proportion of nitrocellulose (and/or a lower proportion of binder) in the container. This, in turn, means that the cartridge possesses an undesirably high flammability and/or lower mechanical properties.

Uniformity in the material structure of the walls of the wet web (and therefore the finished product) is likewise not practical for the following reasons. In order to provide the desired degree of flammability, water vapor permeability, and water absorptivity in any instance, the final products (when of homogeneous composition) must be subjected to a more or less considerable after-treatment by painting or impregnation. These steps generally reduce, however, the combustibility of the finished product.

Up to the present it has been impractical to provide an ammunition component which is of adequate mechanical strength throughout, because to meet this requirement, the composition of the zones under greater mechanical stress must be altered, for example by the addition of strengthening fiber material, so that combustibility of the component as a whole is decreased. It follows, therefore, that it is a determinant advantage if the composition of zones of the ammunition component can be varied at will, since this possibility permits the composition and therefore the strength/combustibility relationship in the respective zones to be optimized.

Since this was not possible by present production methods (where the blank is produced from a suspension of uniform composition by immersion of a hollow shape into a fibrous suspension and with suction applied to the form), portions of the ammunition component (e.g., bottom pieces and upper parts, where a different composition was necessary) had to be produced as separate units which were then cemented together to form the finished component. This was unsatisfactory because of the added work involved and since the cemented joints and overlappings which are necessarily present do not burn or explode in the same manner (i.e., as completely) as the main body of the component.

OBJECTS OF THE INVENTION

One object of the invention is to avoid the abovementioned drawbacks.

Another object of the invention is to provide a unitary ammunition component (i.e., a component which has no cemented joints or overlaps) of variable composition, so that the proportion of the principal components (nitrocellulose fibers, cellulose fibers, and binder) in the principal zones of the component can be varied along the length thereof.

An additional object of the invention is to provide a shaped munitions component in which the combustibility and mechanical strength of the several zones thereof are optimized, so that the component possesses adequate mechanical strength yet when detonated undergoes substantially complete combustion and leaves substantially no residue.

A further object is to provide a simple, safe and economical method for making such a component of such non-uniform composition.

A still further object of the invention is to provide a simple and inexpensive form of apparatus which can be operated automatically or by hand and which is capable of providing the wet web preforms which are necessarily formed in the process.

THE INVENTION

The discovery has now been made that the foregoing objects are substantially met by an improvement in a process for the manufacture of a combustible munitions container wherein a hollow, water-permeable but fiber-impermeable, porous shape of circular cross-section under suction is contacted with an aqueous suspension of nitrocellulose fibers, cellulose fibers, and sythetic binder material, thereby forming a wet web, said web is dried and hot-pressed to form a molded container and said container is trimmed to size. The improvements comprise rotating said forming shape axially and contacting each longitudinal zone of said porous shape, while it is rotating, with a different aqueous suspension containing said fibers and said binder, the nitrocellulose:cellulose: binder ratio in each said suspension being different from the ratio in each other suspension, whereby an ammunition container is produced which is non-uniform in its longitudinal composition.

By this process it is readily feasible to produce shaped products having a bottom of one thickness and sides or walls having zones of different thicknesses.

The first intermediate product is a one-piece wet web which is non-uniform in composition longitudinally but which is of uniform composition in cross-section, and consists essentially of a wet web of a homogeneous mixture of uniformly interfelted fibers, of propellent grade nitrocellulose fibers, cellulose fibers, and a combustible binder thereof. If desired, it can contain synthetic fibers as well.

The second intermediate product is the above web in dry but porous state.

The final product is the above-described web in hot-pressed, fused, and trimmed form.

I have still further found that suitable apparatus for the production of such components comprises a hollow, porous, shaped form for the desired component, means for providing suction within said form, and means for contacting zones of said form with respectively different nitrocellulose fiber-cellulose fiber-binder suspensions.

Shaped combustible components for tube ammunition which vary in composition over their length and which vary in their wall thickness can be produced according to the method of the invention in simple manner, so that the above-mentioned difficulties are avoided.

In the method according to the invention, suspensions of different composition, comprising nitrocellulose fibers, cellulose fibers, synthetic fibers (if desired), one or more synthetic resin binders and, if desired, a supplementary water-insoluble explosive such as pentaerythrityl tetranitrate or trimethylene trinitroamine, are fed in zones to a rotating, hollow, porous, shaped form along its length. The porous form can be enclosed in a closed container, which preferably conforms to the dimensions of the form which it encloses. The suspensions are fed to zones of the porous form as sprays supplied by adjustable feed pumps. A resulting non-woven (i.e., water-laid) web is formed by the action of vacuum in the interior of the form and by the pressure of the feed.

The wet webs are compressed to expel free water therefrom and are then dried. The resulting preforms can be impregnated, if desired, by any known method to provide a content of supplementary combustible material, and then hot-pressed to provide a hard, durable, but combustible container which can be trimmed to the desired size.

More in detail, according to the invention the porous form or shape is composed of any material presently used as the wire in modern paper-making machines. Such wire is a metal screen having a mesh of about to openings per inch. Instead of wire, the porous form can be made of nitrocellulose.

The porous form can be mounted vertically or horizontally. It is preferred to mount it vertically, as this simplifies the manipulative steps involved.

The suspensions are supplied to the porous form at consistencies (i.e., solids content) in the range of 0.1%–5% by weight (solids basis), and preferably in the range of 0.5%–2%.

The suspensions also contain binder material. The binder can be any material or synthetic material which provides an adequately strong ammunition component after the hot-pressing step and the following materials are suitable for the purpose.

Polyurethanes
Polyvinylacetate
Polystyrene
Polybutadienes

The suspensions contain as their principal combustible or explosive components propellent-grade nitrocellulose fibers and cellulose fibers. The cellulose fibers are advantageously of papermaking grade, and may have an absorbed content of one or more dry or wet-strength resins in the customary amount of 0.2%–3% by weight. Long, strong fibers are preferred, such as those made by the kraft process. The suspensions may contain combustible synthetic fibers, for example cellulose acetate and mercerized cotton fibers.

The suspensions can also contain supplementary combustible or explosive material. Any water-insoluble explosive can be present advantageously, and for the purpose I prefer explosives such as pentaerythrityl tetranitrate and trimethylene trinitroamine in particle size ranges heretofore found useful.

Other materials can be present in the suspensions which have heretofore been employed in the manufacture of organic combustible ammunition components by the water-laying method.

The proportions of the aforementioned components in the suspensions which are applied to the various zones of the porous form vary depending on the physical and combustion properties which it is desired that the respective zones of the final product should possess.

As an illustration of a suitable proportion in one instance (the manufacture of cartridge casings), the weight of nitrocellulose and cellulose papermaking fibers in the suspension which contacts the muzzle (open) end of the cartridge are respectively 50%–70% and 15%–35% of the dry weight of the solids in the suspension; and the weight of the binder is in the range of 10%–20% of the dry weight of the three components. The ranges in the suspension which contacts the middle portion of the cartridge are 60%–80%, 15%–25% and 8%–15%, respectively. The ranges in the suspension which contacts the bottom (closed) portion of the cartridge case are 75%–85% nitrocellulose, 8%–15% cellulose fibers and 5%–10% binder. Suitable percentages are selected within these ranges so that the total is 100%. In any instance, suitable proportions can be found by trial.

The invention is further illustrated by the drawings, wherein.

In the drawings, the same numbers represent the same components.

Figure 1:
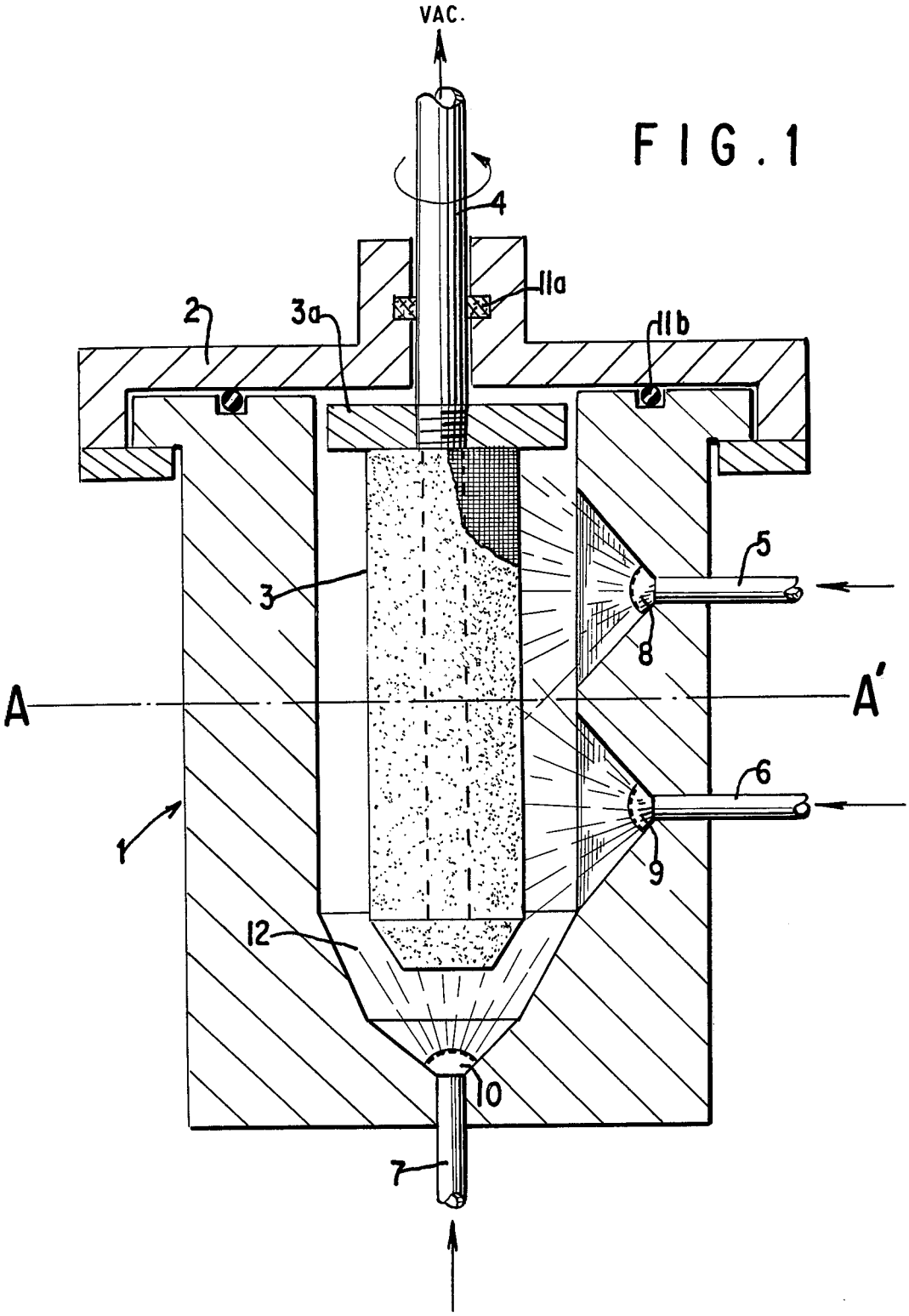
FIG. 1 is a vertical section of one form of apparatus suitable for the production of wet web blanks of ammunition components according to the present invention.

In FIG. 1, shaped outer container 1 provided with removable cover 2 houses porous shape 3 (on which the afore-mentioned wet web is formed) surmounted by lifting flange 3*a*, which is suspended from hollow pipe 4 provided with rotating and vacuum supply means (not shown). Pipe 4 extends to a point just short of the bottom of porous shape 3. Pipes 5 and 6 carry feed of the nitrocellulose-paper fiber-binder suspension into container 1, and pipe 7 provides for the admission of said suspension into the bottom of the chamber. These pipes respectively carry slottype sprayheads 8, 9 and 10, which permit the slurry to be sprayed uniformly over the respective zones of the form. All three pipes pass only part-way through the wall of the chamber and terminate in flared spaces formed by countersinking the respective holes through which the pipes pass; the flared spaces permit the suspensions to be distributed uniformly over the respective zones of the shaping form. Gaskets 11*a* and 11*b* are provided to permit space 12 in chamber 1 to be maintained above atmospheric pressure if desired. Line A—A′ shows that container 1 can be lengthened to provide one or more additional suspension feed pipes and associated flared spaces.

Figure 2:
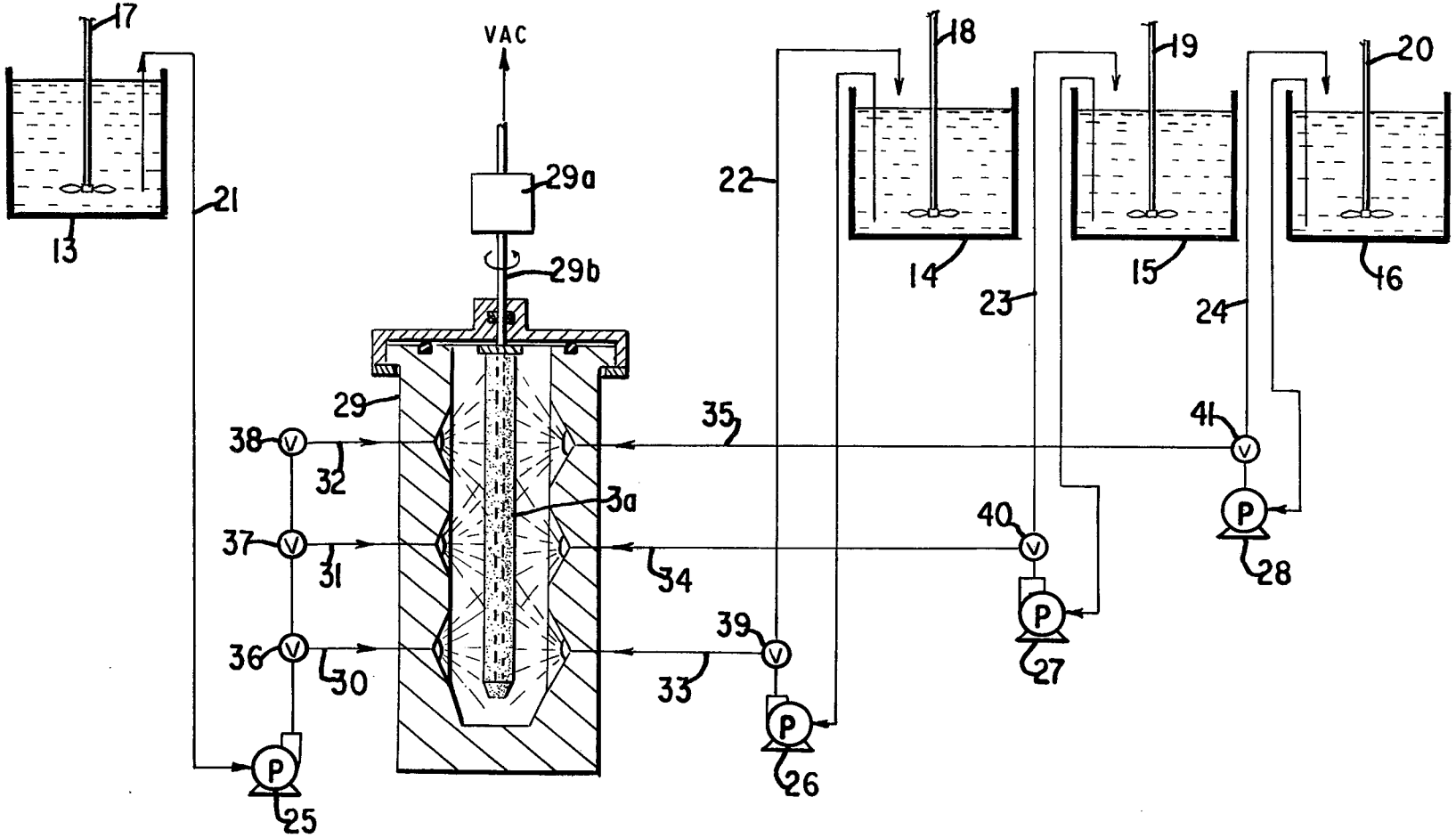
FIG. 2 shows schematically the apparatus of Example 1 associated with component parts.

FIG. 2 shows schematically form-producing part 3*a*.

In FIG. 2, fibrous suspension tanks 13, 14, 15 and 16, respectively provided with stirrers 17, 18, 19 and 20 to maintain their contents uniform, are provided with discharge pipes 21, 22, 23 and 24, which respectively lead to independently controllable feed pumps 25, 26, 27 and 28, the discharges from which are supplied to container 29 provided with head 29*a* which provides vacuum and turning moment through pipe 29*b*. Pipes 30–35 containing independently controllable three-way valves 36, 37, 38, 39, 40 and 41 supply aqueous fibrous suspension to container 29. Valves 36, 37 and 38 permit the discharge of suspension from tank 13 to be distributed among feed pipes 30, 31 and 32. Valves 39, 40 and 41 permit the suspensions which are discharged from tanks 14, 15 and 16 to be circulated back to the respective tanks or to be supplied in any desired proportion respectively through pipes 33, 34 and 35 to container 29 as may be desired in any instance.

Figure 3:
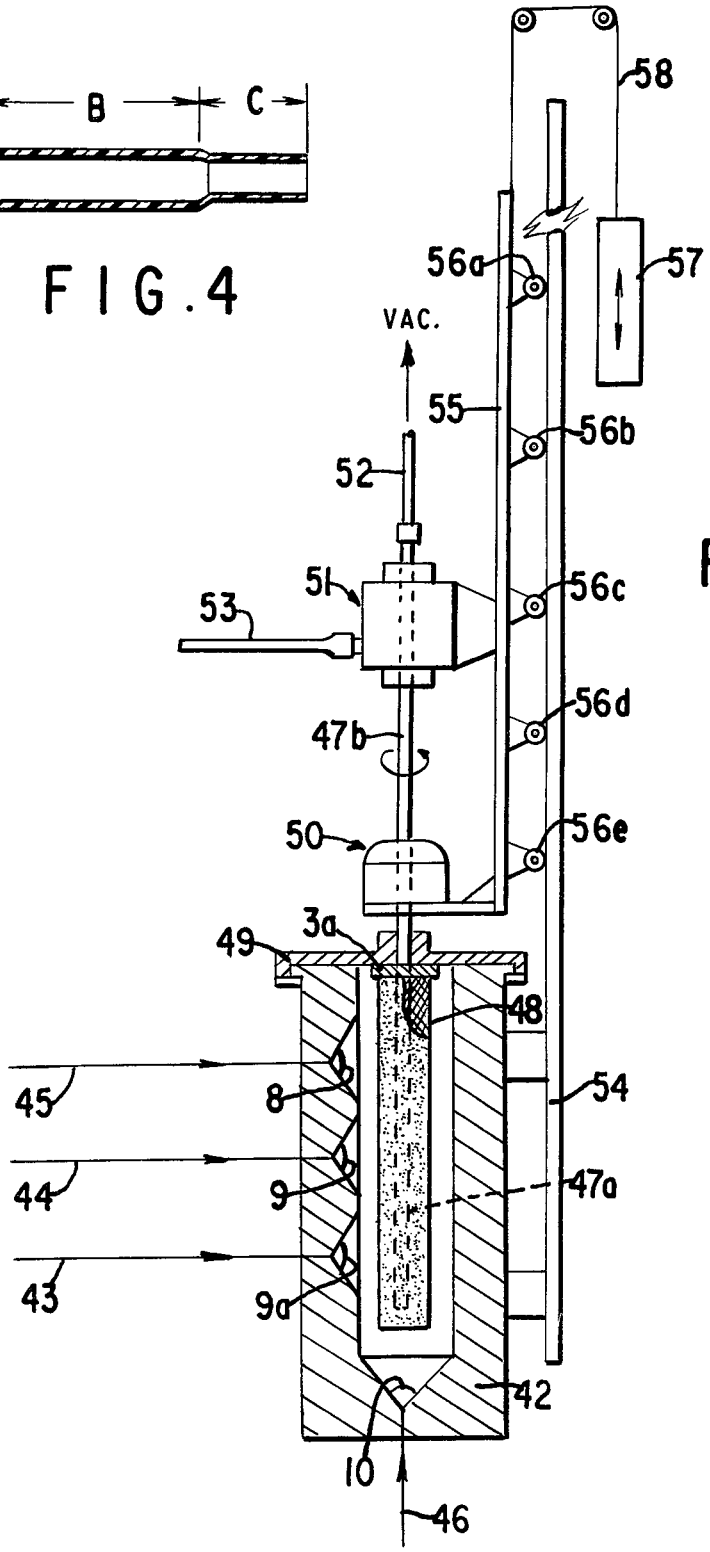
FIG. 3 is a schematic plan view of apparatus similar to that of Example 1 provided with means for lifting out the inner porous shape.

In FIG. 3, container 42 is provided with side feed pipes 43, 44 and 45 and bottom feed pipe 46. Pipe 47*a* (attached to interior porous form 48) is supported by pipe 47*b*, which passes through cover 49 of vessel 42. Pipe 47*b* is rotated by variable speed motor 50 and is surmounted by head chamber 51 to which is connected flexible vacuum supply pipe 52 and flexible water discharge pipe 53 leading to a barometric leg and trap (not shown). Container 42 is fixedly connected to base plate 54. Motor 50 and head chamber 51 are fixed to movable plate 55 provided with rolls 56*a–e* permitting cover 49 of container 42 and porous form 48 within it to be lifted out manually for removal of the wet fibrous web thereon. All apparatus components above container 42 are counterweighted by weight 57 attached through cord 58 to the midpoint of plate 55.

Figure 4:
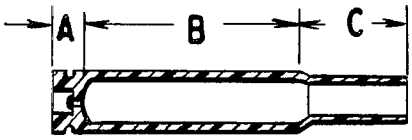
FIG. 4 is a sectional view of a gun cartridge case according to the invention showing its three principal zones.

FIG. 4 is a mid-section drawing of a finished unitary cartridge casing of the present invention. Zone A of the cartridge casing is the base and is of thick cross-section; it contains a high proportion of propellent nitrocellulose and a small proportion of strengthening cellulose and binder. Zone B is the intermediate section and contains a smaller proportion of nitrocellulose and a correspondingly larger proportion of strengthening cellulose and binder. Zone C is the thinnest zone and contains a still smaller proportion of nitrocellulose and a correspondingly larger proportion of strengthening cellulose and binder.

Referring to FIG. 1, the invention is a preferred embodiment is practised by supplying a moderate vacuum to pipe 4, rotating the pipe slowly and supplying fibrous suspensions as described above to pipes 5, 6 and 7 through heads 8, 9 and 10 under a sufficiently high pressure to that the aqueous fibrous suspension is projected satisfactorily uniformly against porous shape 3. The liquid content of the suspension is sucked into the interior of shape 3A and flows to the bottom, from which it is sucked by the vacuum in pipe 4. The operation is continued until a wet fibrous web of desired thickness has been formed on the shaping form. The wet web is then slipped from the form, and in separate steps (not illustrated) is shaped by hot-pressing and is then trimmed to desired size.

The vaccum supplied to the interior of the hollow porous form is no more than that needed to effect efficient transfer of the water into the interior of the form and deposition of the fibers on the outside. A suitable vacuum is any instance depends on the consistency of the suspension, the viscosity of the aqueous phase present, the pore size of the form, and the thickness of the web thereon.

The apparatus of FIG. 2 is employed by filling tanks 13, 14, 15 and 16 with the desired suspensions. The suspensions in tanks 13, 14, 15 and 16 are made uniform by the action of stirrers 17, 18, 19 and 20, and, in the case of tanks 14, 15 and 16, by recirculation of the contents by pumps 26, 27 and 28 with three-way valves 39, 40 and 41 appropriately set. Suction and a slow rotary motion are imparted to shaping form 3 and said three-way valves are turned so as to direct a flow of the respective suspensions through feed pipes 33, 34 and 35, respectively, with sufficient force to spray a uniform coating of the suspensions against said form. If desired, supplementary material can be sprayed onto said form before, during or after web formation through some or all of feed pipes 30, 31 and 32.

When a web of predetermined thickness has built up on the shaping form, the valves controlling the feeds of suspension are closed and the associated pumps are stopped, and the web is further processed as described above.

The device of FIG. 3 is operated in the same manner as is described above. In this device, the vacuum supply and water drainage lines are flexible, and the part of the apparatus above the chamber containing the web formation shape is counterweighted on tracks to permit the web formation shape to be removed, the shape to be returned, and the chamber sealed without the use of tools.

The shaped article of FIG. 4 is essentially a hard, strong, smooth, heat-molded, explosive thermoplastic article which is uniform in its cross-sectional composition but which is non-uniform in its longitudinal composition, the differences in composition being predetermined so that the article is adequately strong in every zone yet undergoes combustion (or explodes) when charged with propellent powder and fired in the usual manner.

The particular methods employed for removal of the wet web from the shaping form, drying and hot-pressing the web, and trimming the resulting molding are known in the art and therefore are not specifically illustrated.

The invention is further illustrated by the example which follows. This example is a preferred embodiment, and is not to be construed in limitation thereof. Parts are by weight except when otherwise stated.

EXAMPLE 1

The following illustrates the manufacture of a container for the propellant charge of a tube weapon which is completely combustible upon discharge of the weapon.

Apparatus similar to that of FIG. 1 is used containing a forming shape known from prior work to be suitable for the production of a cylinder 700 mm. long and 140 mm. in outside diameter. The apparatus is closed. The forming shape is provided with vacuum and is rotated at the speed of 10 r.p.m. The vacuum is thereafter controlled so that substantially all the water in the suspension subsequently admitted is sucked into the interior of the web.

To the apparatus are admitted the following aqueous suspensions.

| Component | Bottom and Lower ⅓ of Cylinder | Top ⅔ of Cylinder |
|---|---|---|
| Nitrocellulose fibers | 74.5% | 60% |
| Kraft cellulose papermaking fibers | 18.5% | 30% |
| Synthetic binder | 7.0% | 10% |

The nitrocellulose used was 12.6% to 12.7% N, and the suspensions had a solids content of 0.4% by weight (dry basis). Spraying was continued for five minutes with a vacuum of 500–700 mm. Hg. maintained in the forming shape. The resulting web was removed from the shape and hot-pressed. The resulting molding was hard and smooth, and had a wall thickness of 2 mm. The transition zone between suspensions was 100 mm. long and the transition from one composition to the other is continuous.

EXAMPLE 2

The following illustrates the manufacture of a combustible ammunition component (a cartridge case) having three longitudinal composition zones.

The apparatus used is similar to that of FIG. 2, containing a shaping form suitable for the production of a cartridge case 800 mm. long and 110 mm. in outside diameter.

The interior of the forming shape is provided with a vacuum and the shaping form is rotated at about 10 r.p.m. Slurries at a consistency of 0.2% solids (dry basis) are admitted through the three feed pipes having compositions as follows.

| Component | Bottom and Lower ⅓ of Case | Middle ⅓ of Case | Top ⅓ of Case |
|---|---|---|---|
| Nitrocellulose fibers 12.5%–12.7% N. | 80.0% | 70.0% | 60.0% |
| Kraft papermaking fibers | 12.0% | 18.0% | 24.0% |
| Synthetic resin binder | 8.0% | 12.0% | 16.0% |
| Totals | 100.0% | 100.0% | 100.0% |

The spraying was continued for 10 minutes. The length between zones was 80 mm. and the transition was continuous.

With continued vacuum, the web was then sprayed over its entire length with a finish coat of suspension having a solids content as follows.

| Component | % by Weight |
|---|---|
| Nitrocellulose fibers | 40.0% |
| Kraft papermaking fibers | 20.0% |
| Siliconized cellulose fibers | 25.0% |
| Synthetic resin binder | 15.0% |
| Total | 100.0% |

The resulting web is removed and finished as described. The product is a hard, smooth, strong, plastic, molded cartridge case having a wall thickness of 1.6 mm. of which 0.1 to 0.2 mm. thereof is the outer finishing coat.

I claim:

1. In a process for the manufacture of a combustible munitions container, wherein a hollow, water-permeable but fiber-impermeable, porous shape under suction is contacted with an aqueous suspension of nitrocellulose fibers, cellulose fibers, and synthetic resin binder material thereby forming a wet web, said web is pressed to remove free water, dried and hot-pressed to form a molded container, the improvements which comprise rotating said forming shape axially and contacting different longitudinal zones of said porous shape with a different aqueous suspension containing said fibers and said binder, the nitrocellulose fiber:cellulose fiber:binder ratio in each said suspension being different from the ratio in each other suspension, whereby an ammunition container is produced which is non-uniform in its longitudinal composition.

2. A process according to claim 1 wherein the weight of nitrocellulose fibers in the suspension which contacts one end of said container is 75% to 85% of the dry weight of the solids in said suspension.

3. A process according to claim 2 wherein the weight of nitrocellulose fibers in the suspension which contacts the other end of said container is 50% to 70% of the dry weight of the solids in said suspension.

4. A process according to claim 1 wherein each of said suspensions has a consistency (dry solids basis) of 0.2% to 2% by weight.

5. A process according to claim 1 wherein said nitrocellulose is of propellant grade.

6. A process according to claim 1 wherein said cellulose fibers are kraft papermaking fibers.

7. A process according to claim 1 wherein said binder is a synthetic resin binder material.

8. A process according to claim 7 wherein the weight of said binder is 5% to 25% of the weight of the solids in said suspension.

9. A process according to claim 1 wherein the suspension also contains pentaerythrityl tetranitrate.

10. A process according to claim 1 wherein the suspension also contains trimethylenetrinitroamine.

11. A process according to claim 1 wherein the amount of suspension which is supplied to the respective zones is varied, so that a web which is non-uniform as to wall thickness is produced.

12. A process according to claim 1 wherein siliconized cellulose fibers are present in said suspensions when said contacting is more than 95% but not entirely complete.

13. A process according to claim 1 wherein the suspension contains synthetic fibers.

14. A unitary ammunition container which is nonuniform is composition axially but which is uniform in composition transaxially, consisting essentially of a substantially completely combustible shell of a compressed and fused, uniformly interfelted, homogeneous mixture of propellant grade nitrocellulose fibers, cellulose papermaking fibers and a combustible binder therefor, the weight ratio of said nitrocellulose fibers to said cellulose papermaking fibers being between 90:10 and 75:25 at one end of said container and between 70:30 and 50:50 at the other end of said container.

15. A container according to claim 14 having a uniformly distributed content of synthetic fibers.

16. A unitary combustible munition container according to claim 13 in the mid-zone of which the ratio of nitrocellulose fibers to cellulose fibers is between 75:25 and 85:15.

17. A container according to claim 13 wherein the outer surface of said container has a uniform content of 15% to 40% by weight of siliconized cellulose fibers.

18. A container according to claim 13 in the form of a cartridge case.

* * * * *